US005358063A

United States Patent [19]

Hedlund et al.

[11] Patent Number: 5,358,063

[45] Date of Patent: Oct. 25, 1994

[54] DRILL BIT

[75] Inventors: Jan-Gunnar Hedlund; Bengt Asberg, both of Houston, Tex.

[73] Assignee: Sandvik AB, Sandviken, Sweden

[21] Appl. No.: 75,561

[22] PCT Filed: Dec. 6, 1991

[86] PCT No.: PCT/SE91/00841

§ 371 Date: Sep. 27, 1993

§ 102(e) Date: Sep. 27, 1993

[87] PCT Pub. No.: WO92/11436

PCT Pub. Date: Jul. 9, 1992

[30] Foreign Application Priority Data

Dec. 21, 1990 [SE] Sweden ..... 9004101-3

[51] Int. Cl.[5] ..... E21B 10/38

[52] U.S. Cl. ..... 175/417

[58] Field of Search ..... 175/417, 418, 419

[56] References Cited

U.S. PATENT DOCUMENTS 1,577,244 3/1926 Brown .

3,995,707 12/1976 Herke ..... 175/417 X

FOREIGN PATENT DOCUMENTS

WO90/15220 12/1990 World Int. Prop. O. .

*Primary Examiner*—William P. Neuder

*Attorney, Agent, or Firm*—Burns, Doane, Swecker & Mathis

[57] ABSTRACT

The present invention related to a drill bit (10) for rock drilling, preferably a down-the-hole drill bit, said drill bit (10) including a head (11) and a shaft (12), said head (11) defining a cutting face (14) that carries a number of hard material button inserts (15) having end portions extending outwardly of said cutting face (14), means (16,17) for transporting flushing medium from the free end (13) of the shaft (12) to the cutting face (14) of the head (11), said means for transporting flushing medium including a central passage (16) extending from the free end (13) of the shaft (12) and terminating in the head (11) short of the cutting face (14) and at least one branch passage (17) emanating from the central passage (16) and emerging in the cutting facc (14).

In the field of down-the-hole drill bits big volumes of flushing medium, normally compressed air, are used since the flushing medium is also activating the down-the-hole hammer. Those big volumes provide erosion of the cutting face since the flushing medium has a very high speed when passing the front face of the drill bit. Said erosion creates problems when so much material, usually steel, of the cutting face had been eroded away that the button inserts are lost before they are worn out.

The idea of the present invention is to decrease the velocity of the flushing medium before reaching the cutting face (14) of the drill bit (10). This is done by increasing the cross-sectional area of the branch passage (17) along a certain length (L) of said branch passage (17).

11 Claims, 4 Drawing Sheets

DRILL BIT

BACKGROUND OF THE INVENTION

The present invention relates to a rock drill bit, preferably a down-the-hole drill bit, said drill bit including a head and a shaft, said head defining a cutting face and carrying a number of hard material button inserts having end portions extending outwardly of said cutting face, means for transporting flushing medium from the free end of the shaft to the cutting face of the head.

In the field of down-the-hole drill bits large volumes of flushing medium, normally compressed air, are used since the flushing medium is also activating the down-the-hole hammer, said hammer demanding large volumes of flushing medium, normally compressed air, to achieve a sufficient penetration rate. Those large volumes provide erosion of the cutting face since the flushing medium has a very high speed when passing the front face of the drill bit. Said erosion creates problems when so much material, usually steel, of the cutting face has been eroded away that the button inserts are lost before they are worn out.

OBJECTS AND SUMMARY

An aim of the present invention is to present a drill bit that has a longer life due to less erosion of the cutting face of said drill bit.

BRIEF DESCRIPTION OF THE DRAWINGS

Below embodiments of the invention will be described, reference being made to the accompanying drawings where.

DETAILED DESCRIPTION OF PREFERRED EMBODIMENTS

Figure 1:
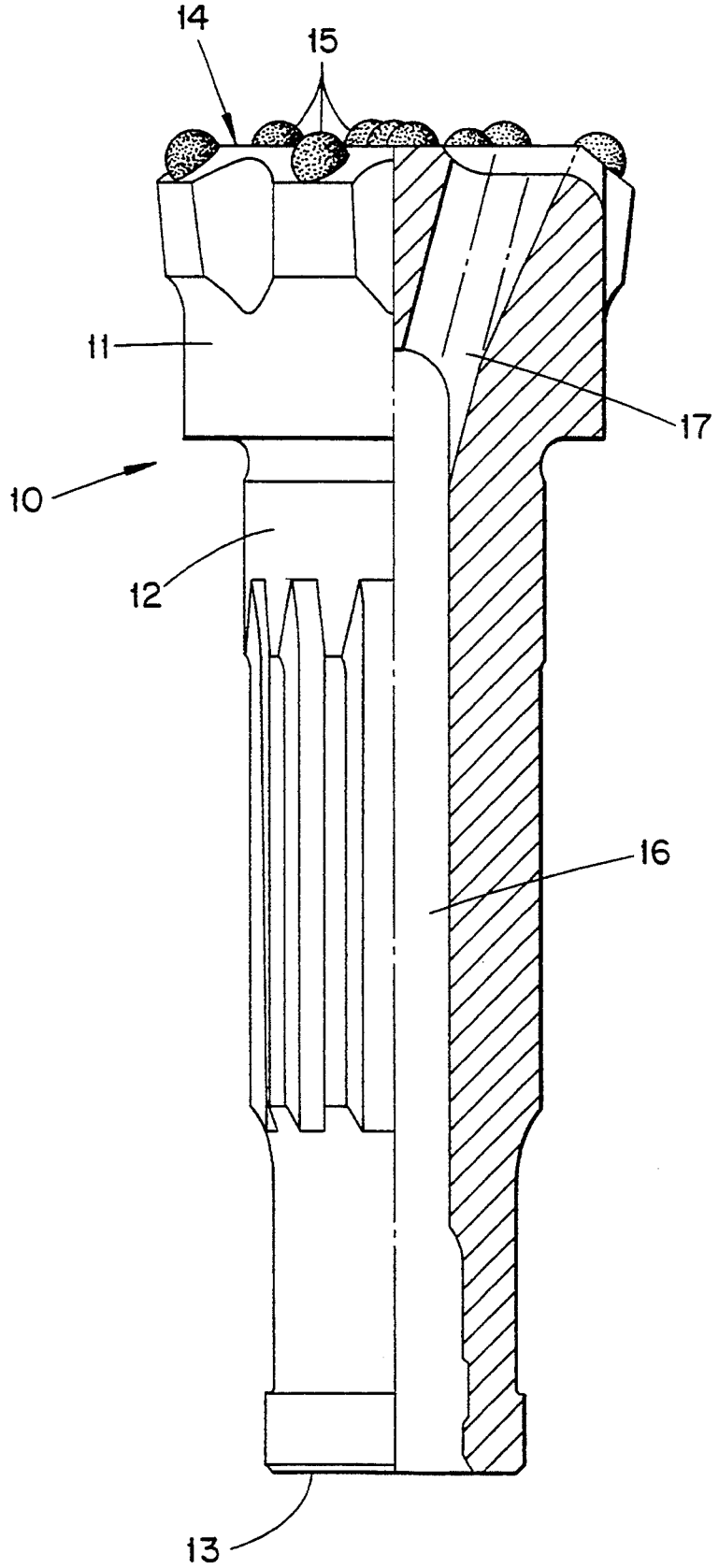
FIG. 1 shows a partly sectioned side elevation of a drill bit according to the present invention.

In the figures corresponding details have been given the same reference numerals.

The drill bit 10 according to FIG. 1 includes a head 11 and a shaft 12 connected to the head 11. The shaft 12 has a surface 13 at its free end, said surface 13 receiving strikes from a piston of a down-the-hole hammer (not shown).

Figure 3:
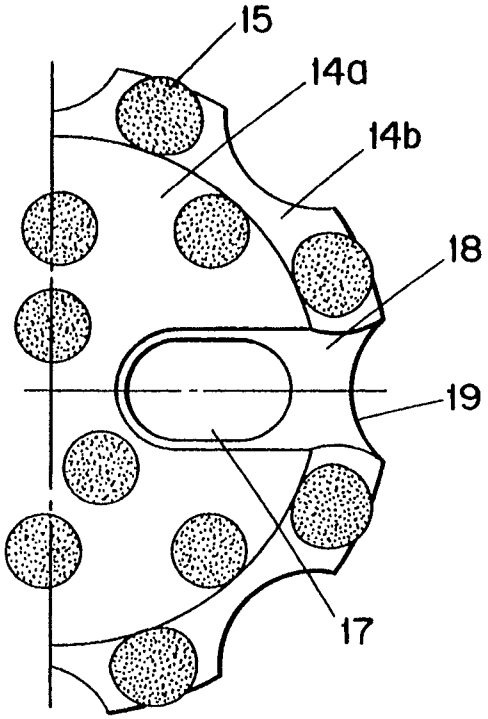
FIG. 3 shows a top view of a cutting face of a drill bit according to the present invention.

The head 11 defines a cutting face 14 having a number of hard material button inserts 15 with end portions extending outwardly of said cutting face 14. As can be seen in FIG. 3 the cutting face 14 has a central planar portion 14*a* and a bevelled portion 14*b* surrounding said central portion 14*a*.

A central passage 16 for flushing medium extends from the surface 13 of the shaft 12 well into the head 11 where said central passage 16 terminates. A number of branch passages 17 emanates from the central passage 16 and diverge outwardly to emerge in the cutting face 14. At a certain distance L from the cutting face 14 the cross-sectional area of the branch passages 17 increases in direction towards the cutting face 14. The shape of said increasing cross-sectional area is not critical and it may also vary along the axial direction of said branch passage 17. In the shown embodiment the branch passage 17 has a circular cross-sectional area closest to the central passage 16 while the increasing cross-sectional area is oval. Preferably the cross-sectional area is continuously increasing from the region of the central passage 16 to the region of the cutting face 14.

Figure 2:
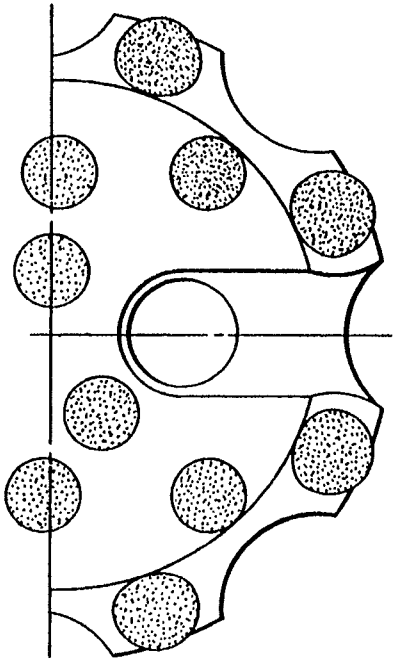
FIG. 2 shows a top view of a cutting face of a drill bit according to prior art.

In FIG. 2 a is shown the cutting face of a down-the-hole drill bit having a branch passage with a constant circular cross-sectional area, i.e. in accordance with prior art. However, in the top view of FIG. 2 the branch passage is slightly oval due to the fact that the branch passage is inclined to the longitudinal center axis of the drill bit.

In FIG. 3 is shown the cutting face 14 of a down-the-hole drill bit 10 according to the present invention. As is apparent from FIG. 3 the branch passage 17 has a clear oval cross-section when emerging into the cutting face 14.

Figure 4:
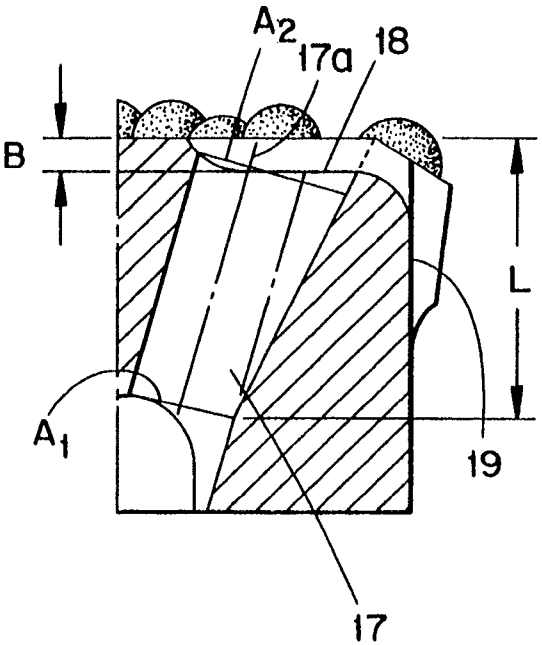
FIG. 4 shows in section a detail of a branch passage of the drill bit according to FIGS. 1 and 3.

To define the increase in cross-sectional area of the branch passage 17 reference is made to FIG. 4. In FIG. 4 $A_1$ defines the area of the branch passage 17 when emanating from the central passage 16 while $A_2$ defines the area of the branch passage 17 when emerging into the cutting face 14. The areas $A_1$ and $A_2$ are perpendicular to a longitudinal axis 17*a* of the branch passage 17. According to the present invention $A_2/A_1 \geqq 1.3$.

In FIG. 4 L defines the length over which the branch passage 17 increases in cross-sectional area. According to the present invention $L \geqq 20$ mm and preferably $L \geqq 30$ mm.

As is evident from FIG. 3 the cutting face 14 is provided with a radial groove 18 that extends from the periphery of the cutting face 14 towards the center of the cutting face 14. Normally said groove 18 terminates before it reaches the center of the cutting face 14. The branch passage 17 emerges in the area of the inner end of said groove 18. This means that a certain amount of the flushing medium will directly be discharged into said radial groove 18 and an axial groove 19 for cuttings, said groove 19 communicating with the radial groove 18 and being arranged on the periphery of the head 11 of the drill bit 10. In the embodiment of FIG. 3 a number of axial grooves 19 are distributed along the periphery.

Since only one half of the drill bit is shown in FIG. 3, said drill bit can include further radial grooves 18. Normally every branch passage 17 emerges in a radial groove 18 that communicates with an axial groove 19 on the periphery of the head 11 of the drill bit 10.

Figure 5:
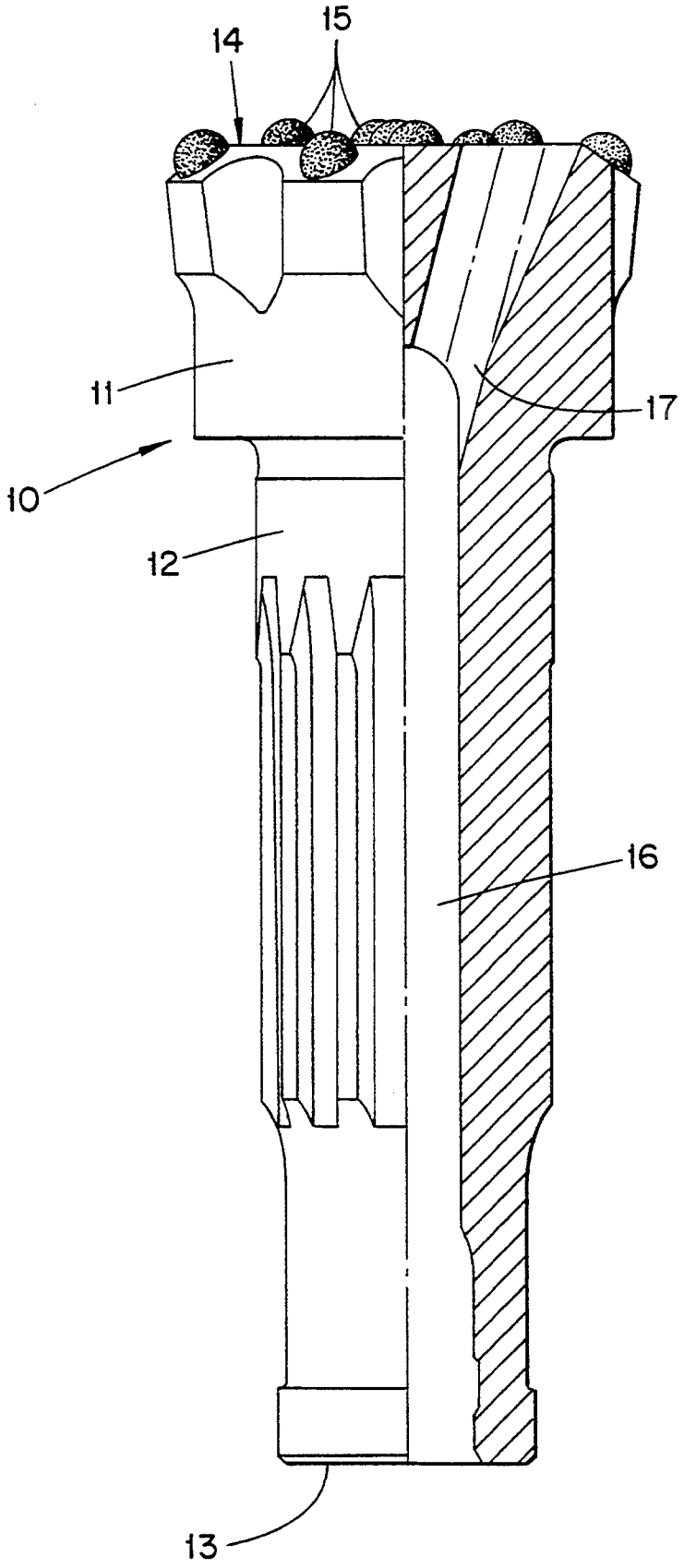
FIG. 5 shows a partly sectioned side elevation of a an alternative embodiment of a drill bit according to the present invention.
Figure 8:
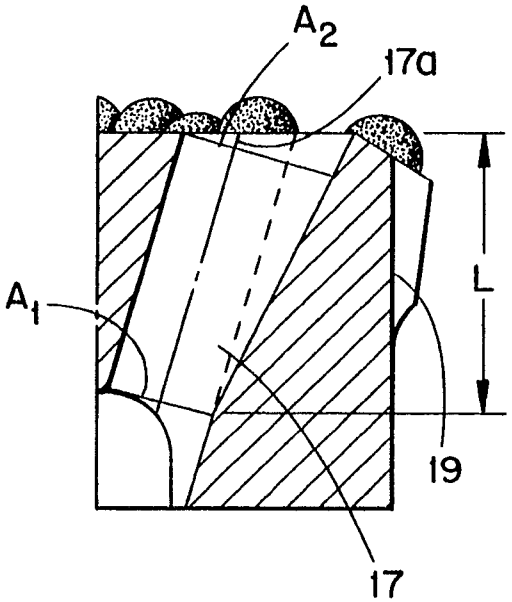
FIG. 8 shows in section a detail of a branch passage of the drill bit according to FIGS. 5 and 7.
Figure 7:
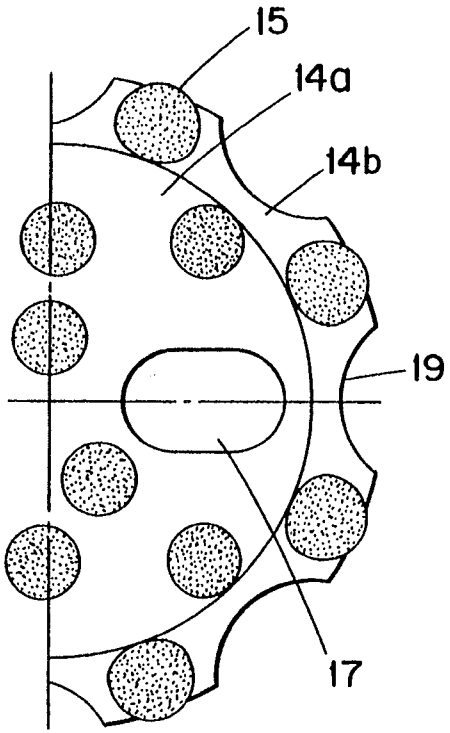
FIG. 7 shows a top view of a cutting face of a drill bit according to the present invention.
Figure 6:
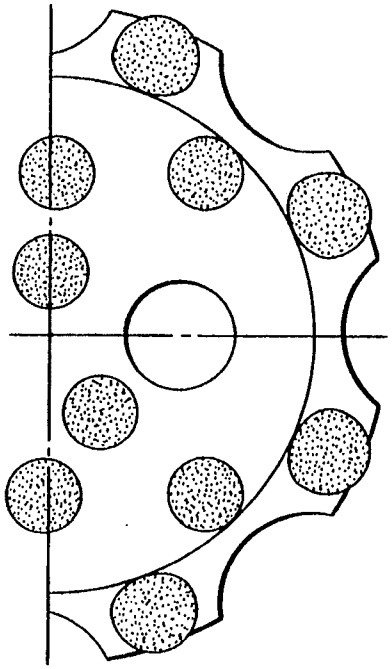
FIG. 6 shows a top view of a cutting face of a drill bit according to prior art.

The embodiment according to FIGS. 5, 7 and 8 differs principally from the embodiment according to FIGS. 1, 3 and 4 in that the radial groove/grooves are omitted. This means that the branch passage 17 emerges in the plane of the central planar portion 14*a* of the cutting face 14.

The relationship between the cross-sectional areas $A_2$ and $A_1$ resp. is the same as in the embodiment according to FIGS. 1, 3 and 4, i.e. $A_2/A_1 \geqq 1.3$. Also the length L is subjected to the same limitations as in the embodiment according to FIGS. 1, 3 and 4, i.e. $L \geqq 20$ mm, preferably $L \geqq 30$ mm.

Since the embodiment according to FIGS. 5, 7 and 8 has no radial groove in the cutting face a larger volume per timeunit of flushing medium will be distributed over the cutting face since no flushing medium is directly discharged to the periphery via a radial groove. This means that the embodiment according to FIGS. 5, 7 and 8 will provide a better flushing of the entire cutting face 14.

Common for both the described embodiments is that the increasing cross-sectional area of the branch passage 17 decreases the velocity of the flushing medium before reaching the cutting face 14, said flushing medium being more evenly distributed over the cutting face 14. This is favourable in that the erosion of the material, usually steel, of the cutting face 14 securing the hard material inserts is decreased. Thus the life of a drill bit in accordance with the present invention is extended compared to prior art drill bits of a corresponding type.

The omitting of the radial groove in the embodiment according to FIGS. 5, 7 and 8 is a development in line with the present invention since the decrease in velocity of the flushing medium makes it possible to have a larger volume per timeunit flushing the cutting face without having an increased erosion of the material of the cutting face 14.

In the embodiments described above only the branch passage 17 of one half of the drill bit is shown. The number of branch passages of a drill bit according to the present invention is at least one. For drill bits having extremely big diameters it is of course possible to have several branch passages 17. When a large number of branch passages 17 are arranged in the drill bit it is favourable to have them connected to the central passage 16 at different levels.

The cross-sectional shape of the portion of the branch passage 17 having a widening cross section is preferably oval but other cross-sectional shapes are also possible, e.g. a circular cross section along the entire length of the branch passage 17.

In the embodiments shown the central portion of the cutting face is planar. However, within the scope of the invention it is possible to have a central portion of the cutting face that is either convex or concave.

The drill bit according to the present invention is in no way restricted to the embodiments described above but can be varied freely within the scope of the appending claims.

We claim:

1. A drill bit for rock drilling, comprising:

a head and a shaft having a free end, said head defining a cutting face that carries a number of hard material button inserts having end portions extending outwardly of said cutting face, means for transporting flushing medium from the free end of the shaft to the cutting face of the head, said means for transporting flushing medium including a central passage extending from the free end of the shaft and terminating in the head short of the cutting face and at least one branch passage emanating from the central passage and emerging in the cutting face, said branch passage being enclosed on all sides thereof, except for the ends, by the head, said branch passage has a widening cross-sectional area in a direction towards the cutting face, the widening of said cross-sectional area of said branch passage is provided along a certain distance L in an axial direction of the drill bit, said distance $L \geqq 20$ mm.

2. Drill bit according to claim 1, wherein the shape of cross-sectional area in the widening section of the branch passage is oval.

3. Drill bit according to claim 1 wherein the cross-sectional area ($A_1$) of the branch passage when emanating from the central passage is related to the cross-sectional area ($A_2$) of the branch passage when emerging into the cutting face in such a way that $A_2/A_1 \geqq 1.3$.

4. Drill bit according to claim 1, wherein the branch passage is emerging in a radial groove in the cutting face.

5. Drill bit according to claim 4, wherein the branch passage is emerging in the radial groove in the region of the inner end of said radial groove.

6. Drill bit according to any claim 4, wherein the radial groove in the cutting face communicates with an axial groove at the periphery of the drill head.

7. Drill bit according to claim 1, wherein the number of branch passages are two.

8. Drill bit according to claim 1, wherein the number of branch passages are three or more.

9. Drill bit according to claim 1, wherein the central passage is integral with the head.

10. A drill bit for rock drilling, comprising:

a head and a shaft having a free end, said head defining a cutting face that carries a number of hard material button inserts having end portions extending outwardly of said cutting face, means for transporting flushing medium from the free end of the shaft to the cutting face of the head, said means for transporting flushing medium including a central passage extending from the free end of the shaft and terminating in the head short of the cutting face, said central passage being integral with the head, and at least one branch passage emanating from the central passage and emerging in the cutting face, said branch passage has a widening cross-sectional area in a direction towards the cutting face, the widening of said cross-sectional area of said branch passage is provided along a certain distance L in an axial direction of the drill bit, said distance $L \geqq 20$ mm.

11. A drill bit for rock drilling, comprising:

a head and a shaft having a free end, said head defining a cutting face that carries a number of hard material button inserts having end portions extending outwardly of said cutting face, means for transporting flushing medium from the free end of the shaft to the cutting face of the head, said means for transporting flushing medium including a central passage extending from the free end of the shaft and terminating in the head short of the cutting face and at least one branch passage emanating from the central passage and emerging in the cutting face, said branch passage has a widening cross-sectional area in a direction towards the cutting face, the widening of said cross-sectional area of said branch passage is provided along a certain distance L in an axial direction of the drill bit, said distance $L \geqq 20$ mm, and said free end of the shaft including means for receiving strikes from a piston of a down-the-hole hammer.

* * * * *